US006343532B1

(12) United States Patent
Lucy

(10) Patent No.: US 6,343,532 B1
(45) Date of Patent: Feb. 5, 2002

(54) CROSS-BAR SOCKET WRENCH

(76) Inventor: Patrick C. Lucy, 1B S. County Rd. 107, Parks, AZ (US) 86018

( * ) Notice: Subject to any disclaimer, the term of this patent is extended or adjusted under 35 U.S.C. 154(b) by 0 days.

(21) Appl. No.: 09/903,928

(22) Filed: Jul. 12, 2001

(51) Int. Cl.[7] ..... B25B 23/16
(52) U.S. Cl. ..... 81/177.6; 81/177.5
(58) Field of Search ..... 81/177.2, 177.6, 81/177.7, 177.5, 177.85

(56) References Cited

U.S. PATENT DOCUMENTS 2,465,152 A * 3/1949 Ellison ..... 81/177.6
2,738,694 A * 3/1956 Boatright ..... 81/177.6
D218,140 S * 7/1970 Johannsen ..... D8/29
4,505,171 A * 3/1985 Chang ..... 81/177.6
4,542,667 A * 9/1985 Jang ..... 81/177.2
5,095,784 A * 3/1992 Garver ..... 81/466
5,421,180 A * 6/1995 Rojdev ..... 81/177.6
5,685,207 A * 11/1997 Hubert ..... 81/177.5
D409,060 S * 5/1999 Lucy ..... D8/24

* cited by examiner

*Primary Examiner*—Eileen P. Morgan
*Assistant Examiner*—Joni B. Danganan
(74) *Attorney, Agent, or Firm*—Haugen Law Firm PLLP

(57) ABSTRACT

A cross-bar socket wrench with a rotatable gripping handle at one end and a socket-engaging tip at the other, and with pivotally mounted torque bars arranged in oppositely disposed relationship intermediate the ends. The torque bars are secured within the driving hub and adapted for rotation between an inwardly retracted stowage disposition and a radially extended drive disposition. In their radially extended working disposition, the torque bars are at an oblique angle of between about 94° and 98° relative to the axis of the shaft so as to effectively elongate the working disposition of the device and to assist in retention during high torque operation.

2 Claims, 3 Drawing Sheets

23
10
12
22
20
19
19
18
16
17
11
18
14

CROSS-BAR SOCKET WRENCH

BACKGROUND OF THE INVENTION

The present invention relates generally to a cross-bar socket wrench having particular utility for use in applying and removing vehicle lug nuts during wheel mounting and wheel removal operations. The cross-bar socket wrench of the present invention has features which better and more expeditiously perform the operation, with the configuration of the device providing for articulation of the cross-bars from a closed or retracted disposition to a highly advantageous extended working disposition.

In the past, cross-bar wrenches have been well known and commonly used by vehicle operators and mechanics for loosening and tightening lug nuts during tire changing procedures. These cross-bar socket wrenches are desirable because they provide for the delivery of substantial torque to the nut, thereby enabling removal of those nuts which may have been inadvertently over-tightened, or which may have become frozen to the studs through corrosion. In either event, the cross-bar socket wrenches of the present invention enable the vehicle operator to loosen the lug nuts for removal and subsequent remounting of a wheel/tire to the vehicle. The term "lug nuts" as used herein is utilized in a comprehensive sense, and thus includes corresponding structure such as lug bolts.

In order to provide for a compact structure, it is desirable to have the cross-bars pivotally coupled to the body of the wrench so that they may be articulated between a retracted disposition during storage, and an extended disposition during use. Thus, the wrench may be conveniently stowed within a pouch in the trunk of a vehicle, and quickly converted to its working disposition whenever needed.

In order to provide for a safe working environment, it is desirable that the hands of the user be positioned away from the socket tip while the wrench is being manipulated. However, the mere extension of length for the shaft forming the body of the wrench simply increases the size of the device, rendering it less compact. Furthermore, when the length of the shaft is increased, it may become necessary to increase the cross-sectional diameter in order to withstand the effects of the application of high torque. The features of the present invention accommodate articulation of the individual cross-bars so that a greater effective working length for the shaft is achieved, while at the same time providing for compact design. These features will be set forth in greater detail hereinbelow.

SUMMARY OF THE INVENTION

In accordance with the present invention, a cross-bar socket wrench is provided which includes a body member consisting of an elongated shaft with a rotatable gripping handle at one end and a socket-engaging tip at the opposed end. A torque bar retaining driving hub is secured to the shaft generally midway between the opposed ends, and a pair of torque bars are in turn coupled to the driving hub and arranged for pivotal rotation between an inwardly retracted storage disposition and a radially extended working disposition. The gripping handle comprises sleeve means which are freely rotatable about the shaft, for accommodating controlled rotation of the wrench body relative to the gripping handle. The rotatable sleeve permits free rotation of the wrench body, with the rotational inertia of the tool, as enhanced by the mass of the hub, being utilized to continue to drive the lug nuts. The driving hub is fast upon the elongated shaft, with the hub including a pair of radially outwardly disposed bar receiving pockets for pivotal articulation of the torque-applying bars. The proximal ends of the bars are pivotally coupled to the hub and adapted for rotation about pivot pins spanning each pocket, and thereby control and guide the pivotal motion of the bars relative to the shaft. In order to provide for greater effective shaft length between the hub and the socket-engaging tip, the configuration of the bar receiving pockets is such that the bars rotate from a retracted disposition substantially parallel with the elongated shaft to an extended working disposition at an oblique angle of at least about 95° relative to the axis of the shaft.

It is a further feature of the invention to utilize torque bars which are solid from end to end, and are not cut-away to form coupling tangs or coupling forks. The pockets formed in the driving hub and into which the cross-bars are fitted are designed to provide minimum working clearance between the outer periphery of the torque bars and the inner surfaces of the pockets. This feature reduces the amount of motion or play which the torque bar may undergo during high torque applications.

Therefore, it is a primary object of the present invention to provide an improved cross-bar socket wrench particularly designed for use in working with lug nuts on vehicle wheels, with the wrench of the present invention providing an increased effective working length for the wrench body while preserving a compact configuration for the wrench during storage.

It is a further object of the present invention to provide an improved cross-bar socket wrench which enables the vehicle operator or the mechanic to more effectively remove and re-apply lug nuts when undertaking a vehicle wheel/tire change.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
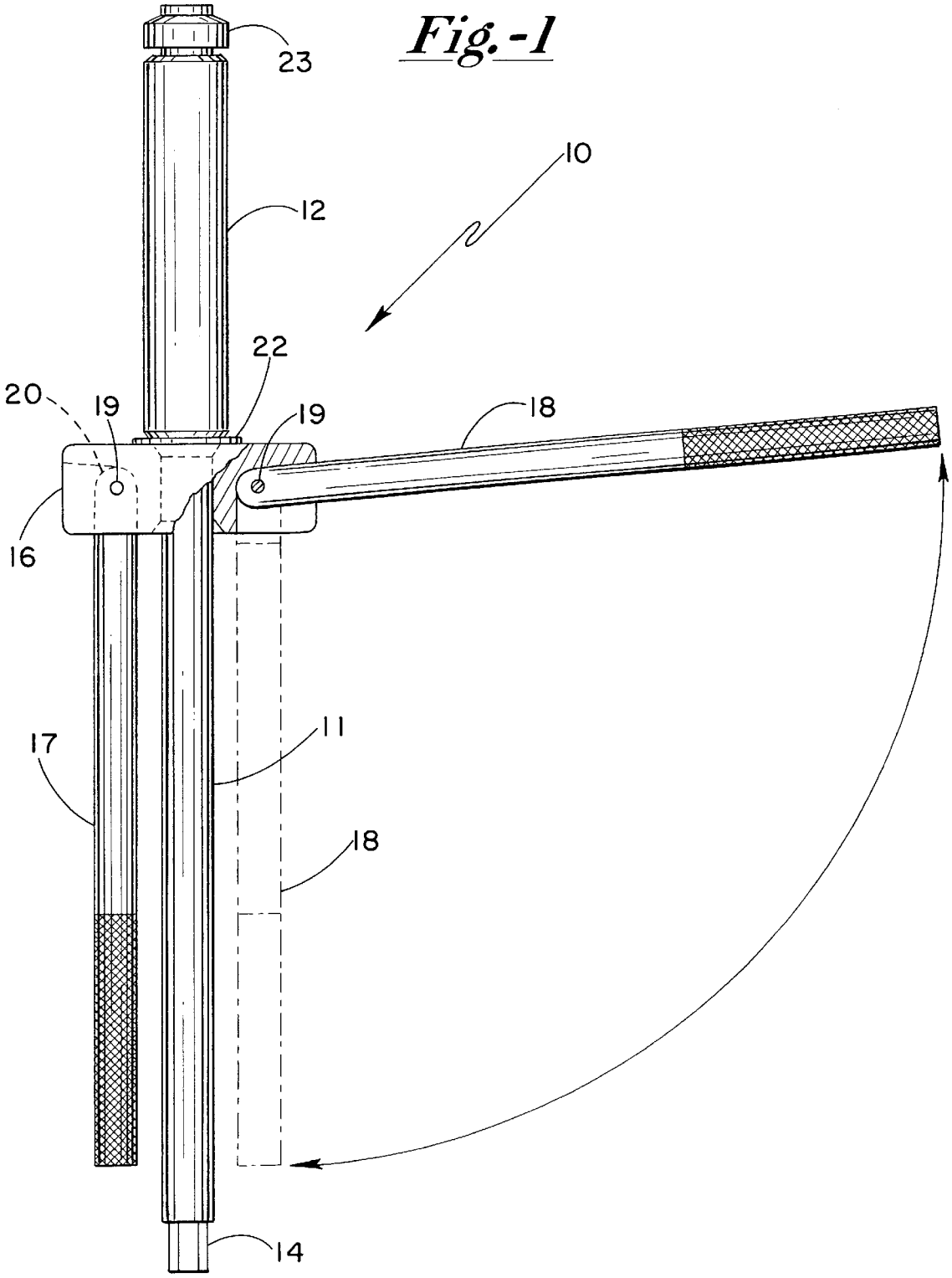
FIG. 1 is an elevational view of the improved cross-bar socket wrench of the present invention, with portions of the hub being shown cut away so as to illustrate the retention of the cross-bars within the hub when in retracted or extended disposition.

In accordance with the preferred embodiment of the present invention, and with particular attention being directed to FIG. 1 of the drawings, the cross-bar socket wrench generally designated 10 includes an elongated shaft 11 forming the body member of the device, having a rotatable gripping handle 12 secured to the outer end thereof. At the opposed end of shaft 11 is a drive portion 14 which includes a square segment upon which the drive socket is received, and which is driven from the flats of the square cross-section of tip 14. Generally midway between opposed ends of shaft 12 is hub 16, with hub 16 receiving and retaining torque bars 17 and 18 therewith in. Torque bars 17 and 18 are pivotally coupled to hub 16 through a spring pin such as at 19. Spring pins 19-19 are, in turn, secured to hub 16 such as by striking the opposed ends of a spring pin with a hammer or other blunt force.

Figure 2:
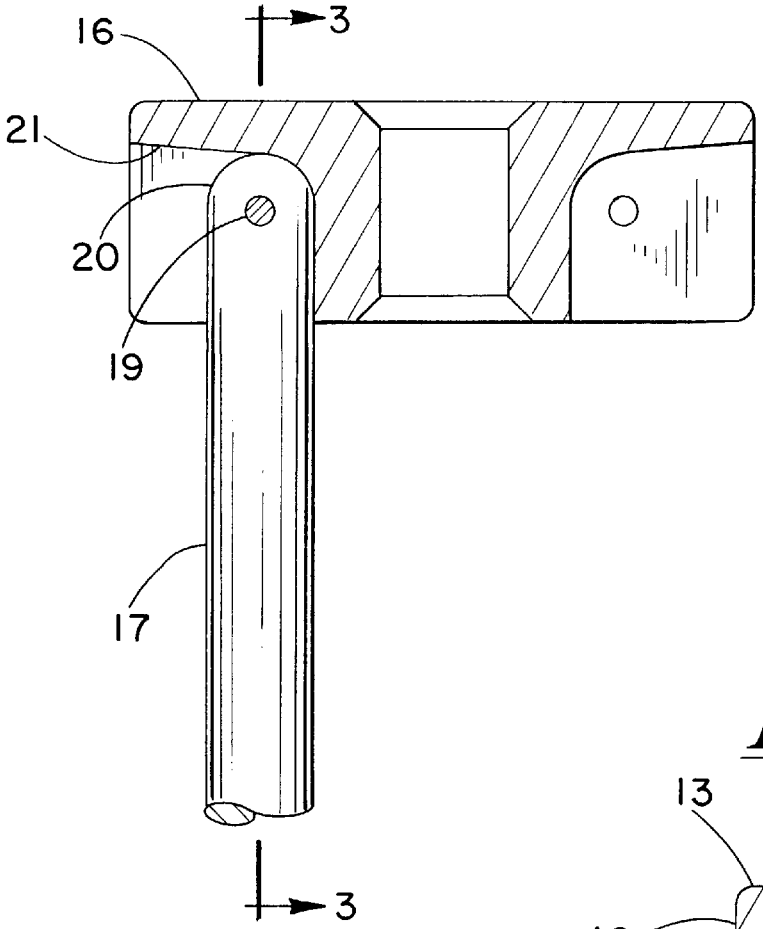
FIG. 2 is a sectional view, on a slightly enlarged scale, illustrating the detail of the manner in which the cross-bars are retained within pockets formed in the driving hub.

With attention being directed to FIG. 2 of the drawings, it will be observed that the pockets such as pocket 21 are configured with the walls in other than right angular relationship, one to the other. In this connection, the angular relationship of the walls defining the pockets such as pocket 21 are preferably at an oblique angle of about 95° to each other, as shown at 24 in FIG. 1. In this connection, a range of between about 94° and 98° is considered useful and preferable. Such an arrangement is advantageous as set forth below. Accordingly, this configuration places the operator's hands and knuckles further from the work object, and furthermore the disposition provides this advantage without significantly detracting from the torque-applying capability of the assembly. In other words, the utilization of the oblique angle reduces the length of the effective lever by only an insignificant amount. Hub 16 along with the remaining components is fabricated from 4340 tool steel, and provides for an elongated line contact between pocket walls and torque bars for added support in high torque applications.

Figure 3:
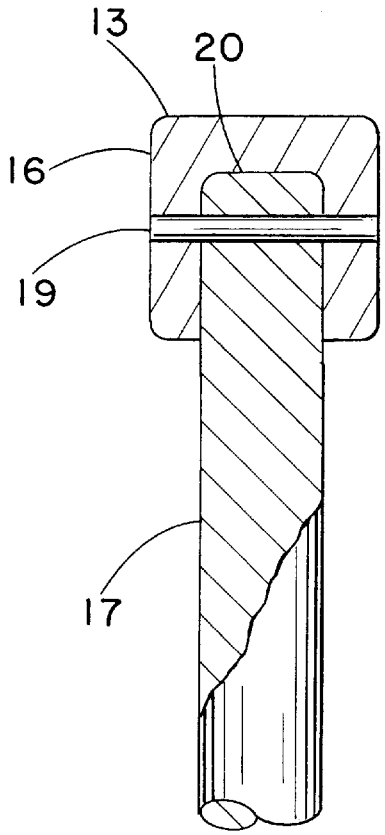
FIG. 3 is a detail sectional view on a slightly enlarged scale along the line and in the direction of the arrows 3—3 of FIG. 1.
Figure 4:
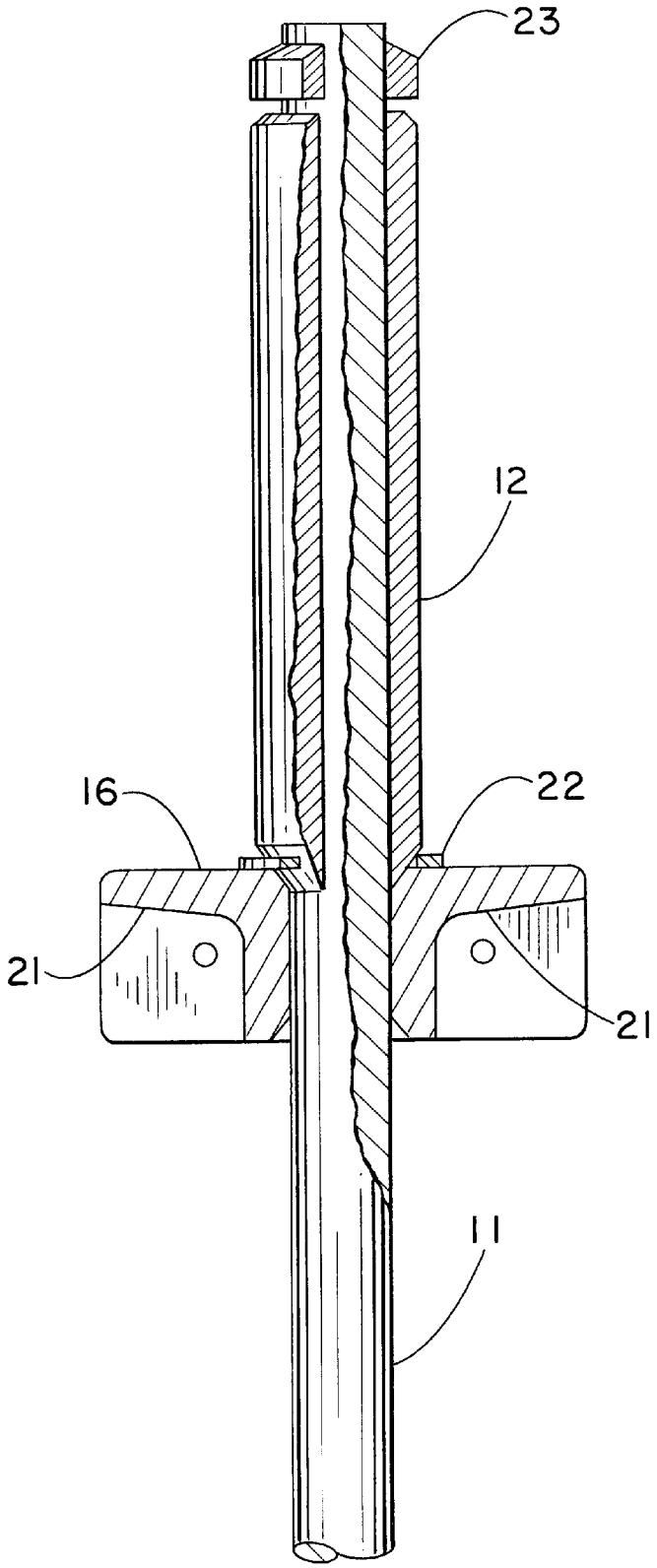
FIG. 4 is a partial sectional view, partially cut away, showing the detail of attachment of the gripping handle to the gripping end of the elongated shaft.

As indicated above, the configuration of the torque bar receiving pockets is such that the outer periphery of the torque bar is received snugly within the pocket. This feature is shown in FIG. 3 of the drawings, with it being understood that limitations of draftsmanship reduce the opportunity to show the close fitting relationship between the individual cross-bars and their receiving pockets. As indicated earlier, this feature virtually eliminates the opportunity for relative radial motion to occur between the captive portion of the cross-bar and its receiving pocket.

With attention now being directed to the gripping handle 12, it will be noted that this handle comprises a sleeve member which is held in position on shaft 11 between washer 22 and cap 23. Since the gripping handle 12 is freely rotatable about the axis of shaft 11, this feature accommodates free rotation of the wrench while being securely held in position by the hand of the user.

With specific attention being directed to FIG. 2 of the drawings, it will be observed that the inner tip or head of each of the torque bars 17 and 18, such as shown at 20 is spherical. Additionally, the configuration of the walls forming the surfaces of pocket 21 are arcuate in both axes, so as to maintain substantially continuous contact between the outer spherical surfaces 20 and the mating inner wall surfaces of pocket 21 particularly while the torque bars 17 and 18 are in their extended working dispositions. These spherical configurations enhance the effectiveness of the torque bars, particularly through increasing the contact area between the torque bars 18 and 18 and the internal surfaces of pocket 21. The arrangement of the spherical head 20 within the pocket 21 is such that slight contact is maintained between the surfaces, particularly as the torque bars are in the extended disposition.

In its overall operation, the cross-bar socket wrench of the present invention is capable of compact storage when the torque bars are in their inwardly retracted dispositions. The wrench is quickly converted to its working disposition by simply pivoting the torque arms or bars outwardly to their radially extended working dispositions. The over-center working disposition provides a way of effectively increasing the working length of the wrench, with the hands of the operator being positioned at a point where unintentional and undesirable knuckle contact with components of the vehicle is not as likely to occur. This feature further insures that the torque bars will remain engaged with the walls of the pockets, thereby reducing the possibility that the bars will become disengaged during application of high torque to the bars.

It will be appreciated that the specific example provided hereinabove is not to be construed as a limitation upon the scope to which the claims are otherwise entitled.

What is claimed is:

1. A cross-bar socket wrench comprising, in combination, a body member consisting of an elongated shaft with a rotatable gripping handle at one end thereof and a socket-engaging tip at the opposed end thereof and with a torque bar retaining driving hub secured to said elongated shaft generally midway between said opposed ends and a pair of torque bars coupled to said driving hub, the combination being characterized in that:

(a) said gripping handle comprises sleeve means mounted coaxially upon said elongated shaft and being freely rotatable thereabouts for accommodating rotation of said elongated shaft relative to said gripping handle;

(b) said driving hub having a central bore for securing said elongated shaft and a pair of radially outwardly disposed bar receiving drive pockets for pivotal articulation of said torque bars formed therewithin;

(c) a pair of elongated torque applying bars pivotally coupled to said hub within said pockets, each bar comprising an elongated body with the proximal end pivotally coupled to said hub and being adapted for rotation about pivot pins secured to said hub, said torque bars being adapted for articulation between inwardly retracted and radially extended dispositions;

(e) the configuration of said bar receiving pockets accommodating pivotal rotation of said elongated torque-applying bars from a retracted disposition substantially parallel with said elongated shaft to an extended working disposition at an oblique angle relative to the axis of said shaft of between about 94° and 98°.

2. The combination of claim 1 wherein said oblique angle is 95°.

* * * * *